United States Patent [19]

Kunze et al.

[11] Patent Number: 4,594,186

[45] Date of Patent: Jun. 10, 1986

[54] METHOD FOR IMPROVING THE RADIONUCLIDE RETENTION PROPERTIES OF SOLIDIFIED RADIOACTIVE WASTES

[75] Inventors: Siegmar Kunze, Gernsbach; Günter Lösch, Leimersheim; Theodor Dippel, Eggenstein, all of Fed. Rep. of Germany; Dietrich Laske, Zurich; Walter Hübner, Baden, both of Switzerland

[73] Assignee: Kernforschungszentrum Karlsruhe GmbH, Fed. Rep. of Germany

[21] Appl. No.: 487,026

[22] Filed: Apr. 21, 1983

[30] Foreign Application Priority Data

Apr. 26, 1982 [DE] Fed. Rep. of Germany ..... 3215508

[51] Int. Cl.[4] ..... G21F 9/16

[52] U.S. Cl. ..... 252/628; 252/631

[58] Field of Search ..... 252/628, 631, 633, 626, 252/627; 264/0.5

[56] References Cited

U.S. PATENT DOCUMENTS

| | | | |
|---|---|---|---|
| 3,988,258 | 10/1976 | Curtiss et al. | 252/628 |
| 4,113,504 | 9/1978 | Chen et al. | 252/628 |
| 4,174,293 | 11/1979 | Colombo et al. | 252/631 |
| 4,253,985 | 3/1981 | Filter et al. | 252/628 |
| 4,269,706 | 5/1981 | Sondermann | 252/631 |
| 4,297,304 | 10/1981 | Scheffler et al. | 264/0.5 |
| 4,299,722 | 11/1981 | Stock et al. | 252/628 |
| 4,363,757 | 12/1982 | Koster et al. | 264/0.5 |

FOREIGN PATENT DOCUMENTS

| | | | |
|---|---|---|---|
| 1082993 | 4/1961 | Fed. Rep. of Germany . | |
| 2603116 | 8/1977 | Fed. Rep. of Germany . | |
| 2717656 | 10/1978 | Fed. Rep. of Germany | 252/628 |
| 9104100 | 10/1974 | Japan | 252/628 |
| 0020520 | 5/1981 | Japan | 252/628 |
| 0020519 | 5/1981 | Japan | 252/628 |
| 0519969 | 1/1978 | U.S.S.R. | 252/628 |

OTHER PUBLICATIONS

U. Ludwig and H. E. Schwiete, "Silicates Industriels" No. 10, 1963 11 pages.

German Industrial Standard (DIN) 51 043, Jan. 1972, 3 pages.

German Industrial Standard (DIN) 1164, Nov. 1978, 4 pages.

*Primary Examiner*—Stephen J. Lechert, Jr.

*Assistant Examiner*—Howard J. Locker

*Attorney, Agent, or Firm*—Sughrue, Mion, Zinn, Macpeak, and Seas

[57] ABSTRACT

Process for solidifying radioactive waste wherein the waste is in solid or aqueous, flowable or liquid form, by mixing the waste with a binder to form a mixture and then leaving the mixture to harden. A mixture of the waste, the binder and an additive which is natural volcanic rock detritus, is formed. The detritus has a total content of CaO+MgO up to a maximum of 6.5 percent by weight and less than 50 percent by weight of residue insoluble in mineral acid. The detritus additive is mixed in an amount between 1 percent by weight and 60 percent by weight of the binder employed.

11 Claims, No Drawings

METHOD FOR IMPROVING THE RADIONUCLIDE RETENTION PROPERTIES OF SOLIDIFIED RADIOACTIVE WASTES

BACKGROUND OF THE INVENTION

The present invention relates to a method for improving the radionuclide retention properties of solidified radioactive wastes wherein the wastes are present in solid or in aqueous, flowable or liquid form, are encased in or mixed with an inorganic and/or an organic binder or binder mixtures containing at least one additive and are then left to harden.

Radioactive wastes, regardless of their origin and type, must be solidified before their final storage, often even before their intermediate storage, to eliminate the risk of uncontrolled entry of radionuclides into the biocycle or to at least substantially reduce such risk. For 25 years or more, a large number of proposals have been made for solidification processes and for solidification matrices. Low to medium radioactive aqueous wastes, such as, for example, aqueous solutions or aqueous concentrates, precipitation sludges, ashes from the combustion of combustible radioactive wastes and solid, radioactively contaminated parts were mixed with or encased in, inter alia, a cement slurry, with or without additives, and left to harden into solid stone-like blocks or shaped bodies.

Spent inorganic or organic ion exchangers containing radioactive substances have also been treated in this manner, and hardening organic resins or polymerizable organic masses have been used as matrices for radioactive waste materials. For example, R. Alberti discloses in German Pat. No. 1,082,993 that a radioactive aqueous liquid can be solidified in an isodispersive grain mixture of, for example, heavy spar, together with a hardening binder, such as, for example Portland cement, alumina cement or oxychloride cement, or by the addition of a casting resin. This patent already proposes measures to further prevent leaching of the incorporated radionuclides, such as, for example, by providing the solidified shaped body with a corrosion-proof coating of a casting resin or Teflon.

For more than 20 years, the experts in the art have attempted to improve the radionuclide retention properties of solidified radioactive wastes. Particularly in solidifications with cement, with or without aggregates, resulting in cement rock or concrete-like products, only partial successes have been realized without complicated and/or expensive measures. Particularly for the radionuclides, which are the most disturbing to the biocycle, the leaching rates in water or aqueous solutions, from radioactive waste products solidified with cement or the like, are still undesirably high. So far, series of experiments have been described in a large number of publications, in which very many types of cement, sometimes mixed with liquid absorbing materials, such as, for example, clays amd/or rock-like substances, have been examined for their usefulness as solidification matrices for radioactive wastes.

Such solidification processes and the resulting solid shaped waste bodies themselves must meet specific requirements which vary according to state law but are often not yet strictly defined. Examples of such requirements are the international transporting regulations for radioactive materials. In this respect, the requirements to be met by a solidified binder mixture with wastes distributed therein as homogeneously as possible are: (1) water resistance (insolubility and shape retention in water or aqueous solutions); (2) sulfate resistance; (3) radiolysis resistance; (4) the most extensive leaching resistance for the radionuclides bound in the solidification matrix, i.e., very low leaching rates or diffusion constants; and (5) chemical and physical stability over long periods of time.

Boric acid containing or borate containing ion exchanger resins containing spent radioactive substances and/or aqueous solutions or concentrates containing boric acid or borate, respectively, often prove difficult to solidify with cement. In past attempts to solidify such wastes, either no compact, solid blocks resulted which had sufficient pressure resistance, instead only cracked and crumbling masses were produced, or the radioactive liquid was not completely incorporated. Although the addition of waterglass (sodium silicate) has been recommended for the solidification of borate containing solutions, this did not bring the desired success with solutions containing more than 5% borate or suspensions containing moe than 5% solid matter. In no case, however, did such products attain sufficient leaching resistance.

German Offenlegungsschrift No. 2,603,116 discloses a method for solidifying radioactive, boron containing aqueous solutions and suspensions containing more than 5% boric acid or borate and more than 5% solids by adding suitable aggregates in the correct sequence, resulting in solid, transportable and storable blocks. In this proposal there is initially added 5 to 30 parts by weight of slaked (hydrated) lime to 100 parts by weight of radioactive solution and then 30 to 80 parts by weight cement. Leaching tests of solidified blocks obtained in this manner have shown, however, that leaching rates for some radionuclides, particularly for cesium-137, are still undesirably high.

SUMMARY OF THE INVENTION

It is an object of the present invention to provide a method with which radioactive wastes are solidified in a manner which significantly improves the retention properties of the resulting solidified products with respect to the incorporated radionuclides.

Another object is to provide such a process with which radioactive wastes from reprocessing plants, from the operation of nuclear power plants, from hospitals, from industry or from research institutes can be solidified in such a manner, or in such a matrix, that the retention properties of the solidified blocks or shaped bodies etc., i.e. of the solidified products ready for permanent storage, are significantly improved with respect to the incorporated radionuclides, particularly for cesium-137.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for solidifying radioactive wastes wherein the waste is in solid or aqueous, flowable or liquid form, by mixing the waste with a binder to form a mixture, and then leaving the mixture to harden, comprising forming a mixture of the waste, the binder and an additive which is natural volcanic rock detritus, the detritus having a total content of CaO+MgO up to a maximum of 6.5 percent by weight and less than 50 percent by weight of residue insoluble in mineral acid, the detritus additive being mixed in an amount between 1 percent by weight and 60 percent by weight of the binder employed.

In an advantageous embodiment of the process according to the present invention, the volcanic rock detritus is from types of Rhenish trass.

In an especially advantageous embodiment of the process according to the present invention, the radioactive waste contains boric acid or borates, and the process employs, in addition to the use of a natural volcanic rock detritus, a further additive in the form of a suspension of $Ca(OH)_2$ in an amount in the range from 3 percent by weight to 25 percent by weight $Ca(OH)_2$ with respect to the binder.

The binder to be mixed can be an organic binder, an inorganic binder, a mixture of inorganic binder and organic binder, and can contain at least one additive. The boric acid or borate containing waste can be an aqueous waste or concentrate or an ion exchanger waste.

It is to be understood that both the foregoing general description and the following detailed description are exemplary and explanatory, but are not restrictive of the invention.

DETAILED DESCRIPTION OF THE INVENTION

Tests have shown that the type of additive, or its origin dependent characteristics, respectively, are decisive for the solution of the problem at hand. Not all natural volcanic rock detritus is able to produce the effect determined and desired by the stated objective. Only those type of detritus have been found to be usable within the scope of the present invention which have a residue insoluble in mineral acid in an amount that is low compared to similar materials, i.e. less than 50 percent by weight (between 26 and 50 wt.%), and a total CaO and MgO content up to a maximum of 6.5 percent by weight. See the publication of U. Ludwig and H. E. Schwiete in "Silicates industriels" No. 10, 1963. The amount of residue insoluble in mineral acid and the amounts of the components in trass, are determined according to German Industrial Standard (DIN) 51043, January 1972, which refers to German Industrial Standard (DIN) 1164, page 3, for measuring the residue insoluble in mineral acid, both of which standards are hereby incorporated by reference. Satisfactory trass, for example, is types of Rhenish trass, but not Bavarian trass (e.g. Suevite(+)). The insoluble residue of Suevite is 50 to 70 percent by weight and its total CaO and MgO content is less than or equal to 11 percent by weight. See German Industrial Standard No. 51043. In the sense of that standard, trass is processed, acid, volcanic tufaceous limestone. Mineralogically, it consists of volcanic glasses and weathered crystalline phases and chemically, predominantly of $SiO_2$ and $Al_2O_3$ (Rhenish trass: $SiO_2$ 25,0 to 35,2 wt%; $Al_2O_3$ 9,6 to 15,2 wt%; Bavarian trass: $SiO_2$ 19,2 to 25,4 wt%, $Al_2O_3$ 4,8 to 8,5 wt%; as disclosed in Ludwig and Schwiete and as determined after boiling the trass in 20 percent HCl for one hour at reflux and after then further treating the resulting residue with a 2% NaOH solution, in accordance with the technique set forth in Ludwig and Schwiete), as well as small portions of earth alkali, iron oxide, alkali and physically as well as chemically bound water. Trass is not an independently hardening binder. Its hydraulic properties become effective only after the addition of lime or cement. It is therefore used in the construction art only in mixtures with lime or lime hydrate and sand or with cement and sand.

(+)The trade name of Suevite is "Nördlinger Traß" (Märker Zementwerke GmbH, Harburg, Germany).

In this context, radioactive wastes in solid or in aqueous, flowable or liquid form are understood to mean, in particular, wastes such as organic ion exchanger resins (spherical and/or powdered resins), precipitation sludges, sludges from the dissolver apparatus of a reprocessing system for irradiated nuclear fuel and/or breeder materials (so-called feed clarification sludges), aqueous waste solutions and aqueous concentrate solutions (highly concentrated salt solutions), ashes from combustion systems, larger solid pieces or broken pieces, as well as mixtures of these types of wastes.

The binder employed in the process of the present invention can be an inorganic binder or an organic binder. Suitable inorganic binders which can be employed in the process according to the present invention are cements, such as, for example, Portland cement, metallurgical (high furnace) cement, alumina cements, pozzolana cements and others. Suitable organic binders which can be used in the process of the present invention are hardening organic compounds, such as, for example, epoxy resins, vinyl resins, polyester resins, etc. Mixtures of inorganic and organic binders can also be employed for the process according to the present invention.

Additionally, substances having sorption properties, such as, for example, vermiculite, or substances having a favorable influence on the porosity and/or pressure resistance of the hardened solidified bodies, such as, for example for cement solidifications, flue ashes or other inorganic highly dispersive filler materials (for example diatomaceous earth), can be added to the not-yet-hardened waste/binder/trass mixtures.

The process according to the invention has numerous advantages. The solidified products according to the present invention employing a cement as binder are distinguished by low porosity, low water penetration, increased sulfate resistance, lower susceptibility to efflorescence and increased stability of the still liquid mixtures before setting due to thixotropy phenomena. During the cement hardening process, trass hardens hydraulically as well while binding existing calcium hydroxide. It is thus very compatible with cement and can therefore be added in larger quantities without substantially decreasing the strength of the final product. Trass is also well compatible with hardenable organic compounds and there acts as an indifferent filler material.

In addition to the above-mentioned general, positive influences on cements, the primary advantage of the addition of trass to the solidification of radioactive wastes is its property of retaining various radionuclides by sorption. This improves the major requirement placed on solidifications, and leaching rates or diffusion constants, respectively, are reduced considerably. Other additives are recommended in literature for cement solidification, likewise with the aim of improving leaching properties. Such additives are primarily clays, marls, zeolites or tuffs. The quantities in which they can be added are limited, since they are not very compatible with cement (e.g. clays and marls can be added only up to a maximum of 10 parts by weight per 100 parts by weight of cement due to extensive worsening of strength) or for reasons of cost. Preferred ranges for the amount of trass that can be employed in the present invention are between 30 and 60 parts by weight per 100 p. by weight of cement.

In addition to the good cement compatibility of trass and the important improvement in leaching properties, a trass addition in cement solidifications offers an additional process technology advantage over mixtures without trass. If, for example, ion exchanger resins are solidified with cements, such mixtures tend to separate before they harden due to the different weights by volume of their components, particularly if cement liquefiers are added. With suitable stirring techniques and the addition of trass, it can be accomplished that such mixtures solidify thixotropically already seconds after cessation of stirring or vibration (for the removal of air). This prevents migration of the light component (ion exchanger resin) to the top and the mass hardens homogeneously.

In the practice of the present invention the detritus additive can be added, for example, to the binder before the waste is mixed in, or when the waste is an aqueous waste can be added to aqueous waste before mixing the waste with the binder. Alternatively, the detritus additive can be added both to the binder and aqueous waste before mixing them together. When employing hydrated lime in the practice of the present invention, it can be added in the same manner as the detritus.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

Cement solidifications of genuine (not simulated) radioactive waste from the Beznau, Switzerland, nuclear power plant, were made with different types of cement under identical process conditions. The radioactive waste was an aqueous, borate containing concentrate containing 15 percent by weight $H_3BO_3$. The composition of Comparison Sample 1 was formulated without the addition of natural volcanic rock detritus, according to the prior art, to provide a comparison for the process according to the present invention which is illustrated by Samples 2 and 3.

The compositions of Samples 1 to 3 are set forth below in parts by weight.

Sample 1

100 parts Addiment
40 parts Beznau concentrate solution

The above mixture contained 56.3 kg concentrate solution in 200 liters of solidification product. Addiment is a product made by Heidelberger Zementwerke, recommended as a ready-to-use, dry cement mixture for borate containing concentrates. Addiment does not contain trass.

Sample 2

100 parts Sulfazem (sulfate resistant Swiss Portland cement)
30 parts trass (Nettetal, a type of Rhenish trass)
20 parts $Ca(OH)_2$ (lime hydrate)
78 parts Beznau concentrate solution The above mixture contained 65.0 kg concentrate solution in 200 liters of solidification product.

Sample 3

100 parts HTS (highly $SiO_2$ containing cement made by Lafarge, Paris, France)
30 parts trass (Nettetal)
20 parts $Ca(OH)_2$ (lime hydrate)
72 parts Beznau concentrate solution The above mixture contained 61.3 kg concentrate solution in 200 liters of solidification product.

The above three solidification products were then subjected to leaching to determine leaching rates for Cs-137 and Co-60. The leaching conditions and the results of the leaching are set forth in Table 1 below.

TABLE 1

Leaching Rates* for Cs-137 and Co-60 in $g/cm^2 \cdot day$ With Leaching Continuing Up To 1 Year.

| | In pure dist. water | | In water saturated with $CaSO_4$ | |
|---|---|---|---|---|
| Sample | Cs-137 | Co-60 | Cs-137 | Co-60 |
| 1 | $6 \cdot 10^{-4}$ | $<3 \cdot 10^{-6}$ | $3 \cdot 10^{-4}$ | $3 \cdot 10^{-6}$ |
| 2 | $9 \cdot 10^{-5}$ | $1.5 \cdot 10^{-6}$ | $2 \cdot 10^{-5}$ | $1.5 \cdot 10^{-6}$ |
| 3 | $5 \cdot 10^{-5}$ | $1.5 \cdot 10^{-6}$ | $6 \cdot 10^{-6}$ | $1.5 \cdot 10^{-6}$ |

*Leaching tests were always performed at 20°C. according to the recommendation in ISO Standard ISO/DIS 6961/TC 85 of December 20th, 1977.

The values shown in Table 1 clearly evidence the improvement in leaching resistance of the products from the process according to the present invention with respect to Cs-137 when compared to those from the best known prior art processes for the solidification of borate containing concentrates. Values for Co-60 remained approximately the same.

EXAMPLE 2

This example illustrates the influence of increasing proportions of trass in cement solidifications of genuine radioactive waste from the nuclear power plant at Mühleberg, Switzerland. The radioactive waste comprises Powdex ion exchanger resins (powdered resins).

Various samples were prepared whose compositions are set forth below in parts by weight:

Sample 4a 100 parts Sulfazem (sulfate resistant Swiss Portland cement)
20 parts Powdex resins (ion exchanger sold under the trade name Powdex; manufactured according to Swiss Pat. No. 462,114) having a 50% moisture content
20 parts Rhenish trass and
45 parts additional water.

Sample 4b

Sample 4b had the same composition as Sample 4a, except the Rhenish trash and additional water were employed in an amount of 30 parts Rhenish trass and 49 parts additional water.

Sample 4c

Sample 4c had the same composition as Sample 4a, except the Rhenish trash and additional water were employed in an amount of 40 parts Rhenish trass and 54 parts additional water.

Sample 4d

Sample 4d had the same composition as Sample 4a, except the Rhenish trash and additional water were employed in an amount of 60 parts Rhenish trass and 62 parts additional water.

Samples 5a through 5d

Samples 5a through 5d had the same compositions as Samples 4a through 4d, respectively, except HTS (highly $SiO_2$ containing cement made by Lafarge, Paris, France) was employed as the cement component instead of Sulfazem.

The above solidification products were then subjected to leaching to determine leaching rates for Cs-137. The leaching conditions and the results of the leaching are set forth in Table 2 below.

TABLE 2

| | Leaching Rates for Cs-137 in $g/cm^2 \cdot$ Day With Leaching Continuing Up To 1 Year | |
|---|---|---|
| Sample | dist. In pure/water | In water saturated with $CaSO_4$ |
| 4a | $9.2 \cdot 10^{-5}$ | $4.9 \cdot 10^{-6}$ |
| b | $5.7 \cdot 10^{-5}$ | $3.1 \cdot 10^{-6}$ |
| c | $4.7 \cdot 10^{-5}$ | $3.3 \cdot 10^{-6}$ |
| d | $3.0 \cdot 10^{-5}$ | $1.9 \cdot 10^{-6}$ |
| 5a | $4.9 \cdot 10^{-5}$ | $4.0 \cdot 10^{-6}$ |
| b | $3.5 \cdot 10^{-5}$ | $3.7 \cdot 10^{-6}$ |
| c | $2.0 \cdot 10^{-5}$ | $1.6 \cdot 10^{-6}$ |
| d | $1.2 \cdot 10^{-5}$ | $1.6 \cdot 10^{-6}$ |

As can be seen from Table 2, in the case of powdered resin solidifications as well, improved leaching resistance was noted in the solidified products. The leaching rate decreased with increasing amounts of trass in the solidified product.

EXAMPLE 3

This example illustrates the influence of increasing proportions of trass in the cement solidification of genuine radioactive waste from the nuclear power plant at Beznau, Switzerland. The radioactive waste comprised Lewatit ion exchanger resins (spherical resins).

Various samples were prepared whose compositions are set forth below in part by weight.

Sample 6a 100 parts Sulfazem
33 parts Lewatit resins (polystyrene resins with sulfonic acid groups or with quaternary amino groups made by Bayer AG) having a 50% moisture content
3 parts liquefier based on sulfonated naphthalene formaldehyde condensates sold under the trade name Sikament
30 parts Rhenish trass, and
26 parts additional water.

Sample 6b

Sample 6b had the same composition as Sample 6a, except that the Rhenish trass and additional water were employed in amounts of 60 parts Rhenish trass and 35 parts additional water.

Sample 7a and b

Samples 7a and b had the same compositions as Samples 6a and b, respectively, except HTS was employed as the cement component instead of Sulfazem.

Sample 8a 100 parts Sulfazem
66 parts Lewatit resins (with 50% moisture)
3 parts liquefier (Sikament)
20 parts Rhenish trass, and
23 parts additional water.

Sample 8b

Sample 8b had the same composition as Sample 8a, except that the Rhenish trass and additional water were employed in amounts of 30 parts Rhenish trass and 30 parts additional water.

Sample 8c

Sample 8c had the same composition as Sample 8a, except that the Rhenish trass and additional water were employed in amounts of 40 parts Rhenish trass and 31 parts additional water.

Sample 8d

Sample 8d had the same composition as Sample 8a, except that the Rhenish trass and additional water were employed in amounts of 60 parts Rhenish trass and 37 parts additional water.

Samples 9a through 9d

Sample 9a through 9d had the same compositions as Sample 8a through 8d, respectively, except HTS was improved as the cement component instead of Sulfazem.

The above solidification products were then subjected to leaching to determine leaching rates for Cs-137 and Sr-90. The leaching conditions and the results of the leaching are set forth in Table 3 below.

TABLE 3

| | Leaching Rates For Cs-137 and Sr-90 in $g/cm^2 \cdot$ Day With Leaching Continuing Up To ½ Year | | | |
|---|---|---|---|---|
| | In pure, distilled water | | In water saturated with $CaSO_4$ | |
| Sample | Cs-137 | Sr-90 | Cs-137 | Sr-90 |
| 6a | $14.4 \cdot 10^{-5}$ | $3.9 \cdot 10^{-4}$ | $7.7 \cdot 10^{-6}$ | $0.9 \cdot 10^{-6}$ |
| b | $7.7 \cdot 10^{-5}$ | $8.0 \cdot 10^{-4}$ | $6.7 \cdot 10^{-6}$ | $0.5 \cdot 10^{-6}$ |
| 7a | $5.0 \cdot 10^{-5}$ | $5.1 \cdot 10^{-4}$ | $3.9 \cdot 10^{-6}$ | $1.2 \cdot 10^{-6}$ |
| b | $3.8 \cdot 10^{-5}$ | $4.2 \cdot 10^{-4}$ | $1.7 \cdot 10^{-6}$ | $0.2 \cdot 10^{-6}$ |
| 8a | $30.5 \cdot 10^{-5}$ | $8.4 \cdot 10^{-4}$ | $8.5 \cdot 10^{-6}$ | $0.2 \cdot 10^{-6}$ |
| b | $23.5 \cdot 10^{-5}$ | $8.6 \cdot 10^{-4}$ | $9.0 \cdot 10^{-6}$ | $0.7 \cdot 10^{-6}$ |
| c | $17.5 \cdot 10^{-5}$ | $6.4 \cdot 10^{-4}$ | $8.5 \cdot 10^{-6}$ | $0.6 \cdot 10^{-6}$ |
| d | $10.9 \cdot 10^{-5}$ | $6.4 \cdot 10^{-4}$ | $4.6 \cdot 10^{-6}$ | $0.8 \cdot 10^{-6}$ |
| 9a | $14.0 \cdot 10^{-5}$ | $7.7 \cdot 10^{-4}$ | $4.0 \cdot 10^{-6}$ | $0.7 \cdot 10^{-6}$ |
| b | $14.9 \cdot 10^{-5}$ | $7.4 \cdot 10^{-4}$ | $4.3 \cdot 10^{-6}$ | $0.5 \cdot 10^{-6}$ |
| c | $8.7 \cdot 10^{-5}$ | $5.9 \cdot 10^{-4}$ | $3.0 \cdot 10^{-6}$ | $0.2 \cdot 10^{-6}$ |
| d | $7.3 \cdot 10^{-5}$ | $6.4 \cdot 10^{-4}$ | $2.5 \cdot 10^{-6}$ | $0.3 \cdot 10^{-6}$ |

EXAMPLE 4

This example illustrates comparative tests of cement solidification of a powdered resin mixture and a spherical resin mixture, each with and without trass.

Samples 10a and 10b

Samples 10a and 10b employed a powdered resin mixture.

A powdered resin mixture charged with cesium-137 was saturated with water and mixed with HOZ-35L/HS-NW high furnace cement[i] and water corresponding to the following weight percentages in the final product:

In Sample 10a, 52.5% HOZ, 13.1% trass, 6.6% powdered resin (based on its dry weight) and 27.8% total water (mixing water and water to saturate the resin);

In Sample 10b, 65.6% HOZ, 0% trass, 6.6% powdered resin (based on its dry weight) and 27.8% total water (mixing water and water to saturate the resin).

(i) 35=35 N/mm², L=slow initial hardening, HS=high sulfate resistance, NW=low hydration heat.

Thus, Sample 10b did not contain any trass, whereas in Sample 10a, 20% of the cement employed in Sample 10b was replaced by trass.

The products were stored at room temperature for 28 days in a closed vessel and then, for 365 days, subjected to leaching in three different mediums, namely distilled water, quinary salt solution(ii) and saturated sodium chloride solution. The products were then examined.

In Sample 11b, 48.6% HOZ, 0% trass, 15.6% spherical resin (based on its dry weight) and 35.8% total water (mixing water and water to saturate the resin).

Thus, Sample 11b did not contain any trass, whereas in Sample 11a approximately 20% of the cement employed in Sample 11b was replaced by trass. The products were stored for 28 days in a closed container at room temperature, and then subjected for 365 days to leaching in distilled water and examined.

Leaching was performed according to the ISO test but without exchange of the distilled water. The water saturated spherical resins contained approximately 50 weight percent water which, merely as a matter of calculation, is included in the term total water.

The results are compiled in the following Table 4:

TABLE 4

Leaching Results of Ion Exchanger Resin Cement Products
(ISO Test Without Exchange of Leaching Medium at 20° C.)
10 = powdered resin mixture 11 - spherical resin mixture

| | Weight % in Final Product | | | | | Leaching Results Diffusion Constants of Cs-137 in $cm^2 \cdot d^{-1}$ | | |
|---|---|---|---|---|---|---|---|---|
| Resin Mixture | Cement | Trass+ | Resin | Total Water | $\frac{W}{Z}$ | Dist. Water | Quinary Salt Solution | Saturated NaCl Solution |
| 10a | 52.5 | 13.1 | 6.6 | 27.8 | 0.42 | $8.0 \cdot 10^{-7}$ | $9.1 \cdot 10^{-5}$ | $1.3 \cdot 10^{-5}$ |
| b | 65.6 | — | 6.6 | 27.8 | 0.42 | $3.7 \cdot 10^{-4}$ | $1.7 \cdot 10^{-3}$ | $1.1 \cdot 10^{-3}$ |
| 11a | 38.8 | 9.8 | 15.6 | 35.8 | 0.74 | $1.8 \cdot 10^{-6}$ | — | — |
| b | 48.6 | — | 15.6 | 35.8 | 0.74 | $6.5 \cdot 10^{-5}$ | — | — |

+1/5 (20 weight percent) of cement replaced by trass (ii) quinary salt solution contains: 0.2% NaCl; 0.6% KCl, 34.0% $MgCl_2$, 2.0% $MgSO_4$, 63.2% water.

The leaching was performed according to the ISO test, but without exchange of leaching medium. The water saturated powdered resins contained approximately 60 weight percent water which, merely as a matter of calculation, is included in the term total water.

Samples 11a and 11b

Samples 11a and 11b employed a spherical resin mixture.

A spherical resin mixture charged with cesium-137 was saturated with water and mixed with HOZ-35L/HS-NW(i) and water, corresponding to the following weight percentages in the final product:

In Sample 11a, 38.8% HOZ, 9.8% trass, 15.6% spherical resin (based on its dry weight) and 35.8% total water (mixing water and water to saturate the resin);

The improvement in leaching resistance of the solidified products according to the present invention with the addition of trass, compared to the products without the addition of trass is clearly evident. Moreover, an increase in pressure resistance of the products was noted with the following tendency: without trass (after 28 days of humid storage)<with trass (28 days of humid storage)<after 365 days of storage in distilled water<after 365 days of storage in quinary liquor.

EXAMPLE 5

This example illustrates leaching results of boric acid containing spherical resin cement products with and without the addition of trass and white lime hydrate (WKH), tracered with Cs-137 and Co-60 in the same order of magnitude. The compositions of the various samples, the leaching conditions and the leaching results are set forth in Table 5 below. In all experiments, the leaching rates $R_L$ for Co-60 were in the order of magnitude of $4 \cdot 10^{-5}$[$g \cdot cm^{-2} \cdot d^{-1}$].

TABLE 5

| | Weight Percent in the Finished Product | | | | | | | | $R_L$ Cs-137 $g \cdot cm^{-2} \cdot d^{-1}$ |
|---|---|---|---|---|---|---|---|---|---|
| Sample No. | High Furnace Cement HOZ-35L/HS-NW | Rhen. Trass | WKH $Ca(OH)_2$ | Lewatit Spherical Resin Mixture S100/N500 (dry) | $LiOH^{++}$ | $H_3BO_3^{++}$ | Total Water | $\frac{W}{Z}$ value | Dist. Water 20° C., 90 days |
| 12 | 42.2 | 13 | 9.7 | 7.0 | 0.26 | 1.7 | 26.1 | 0.40 | $1.7 \cdot 10^{-4}$ |
| 13 | 67.8 | — | — | 7.0 | 0.26 | 1.7 | 23.2 | 0.34 | $7.8 \cdot 10^{-4}$ |
| 14 | 54.2 | 13.6 | — | 7.0 | 0.26 | 1.7 | 23.2 | 0.34 | leached body decomposes after 24 hours |
| 15 | 67.8+ | — | — | 7.0 | 0.26 | 1.7 | 23.2 | 0.34 | $7.4 \cdot 10^{-4}$ |
| 16 | 42.1 | 13 | 9.7 | 7.0 | 0.26 | 1.82 | 26.1 | 0.40 | $5.6 \cdot 10^{-4}$ |
| 17 | 67.7 | — | — | 7.0 | 0.26 | 1.82 | 23.2 | 0.34 | leached body decomposes after 24 hours |
| 18 | 54.1 | 13.6 | — | 7.0 | 0.26 | 1.82 | 23.2 | 0.34 | leached body decomposes after |

TABLE 5-continued

| Sample No. | Weight Percent in the Finished Product: High Furnace Cement HOZ-35L/HS-NW | Rhen. Trass | WKH $Ca(OH)_2$ | Lewatit Spherical Resin Mixture S100/N500 (dry) | $LiOH^{++}$ | $H_3BO_3^{++}$ | Total Water | $\frac{W}{Z}$ value | $R_L$ Cs-137 $g \cdot cm^{-2} \cdot d^{-1}$ Dist. Water 20° C., 90 days 24 hours |
|---|---|---|---|---|---|---|---|---|---|

Explanations Regarding Table 5

+industrial product frequently used in nuclear power plants instead of HOZ-35L/HS-NW (Addiment KW 3 made by Heidelberger Zementwerke)

++bound in the moist spherical resin mixture:

1.7 percent by weight $H_3BO_3$ in the end product correspond to 175 g/l resin;

1.82 percent by weight $H_3BO_3$ in the end product correspond to 190.7 g/l resin;

0.26 percent by percent LiOH in the end product correspond to 38.3 g/l moist resin.

A comparison of the cement products without additives with those in which part of the cement was replaced by trass alone, or by trass and WKH, shows that in boron containing ion exchanger cement solidifications with the addition of trass, the addition of WKH was required and that the leaching rates for Cs-137 were improved by the addition of trass and WKH.

Tests regarding the pressure resistances of the solidified boron containing ion exchanger products have shown that the pressure resistance of products without trass and WKH is considerably reduced after storage in water, sometimes with the result that the blocks decompose, whereas the boron containing products according to the process of the present invention (with trass and WKH) after storage in water exhibit increased pressure resistance (up to a multiple) compared to before leaching. In practice, this means the realization of an additional safety barrier for such solidifications.

EXAMPLE 6

This example illustrates leaching results of feed clarification sludge cement products with and without the addition of trass and standard sand (feed clarification sludge (FKS)=fuel solution residue).

The composition of the various samples, the leaching conditions and the leaching results are set forth in Table 6 below.

TABLE 6

| Sample No. | Weight Percent in the Final Product: High furnace Cement HOZ-35L/HS-NW | Rhen. Trass | Stand. Sand | FKS (dry) | Total Water | $\frac{W}{Z}$ value | $R_L$ [$g \cdot cm^{-2} \cdot d^{-1}$] dist. water, 20° C. 46 days: Cs-137 | Ru-106 | Sb-125 |
|---|---|---|---|---|---|---|---|---|---|
| 19 | 68.8 | — | — | 0.5 | 30.7 | 0.45 | $2.1 \cdot 10^{-4}$ | $0.5 \cdot 10^{-6}$ | $2.4 \cdot 10^{-6}$ |
| 20 | 55.2 | 13.6 | — | 0.5 | 30.7 | 0.45 | $2.0 \cdot 10^{-5}$ | $0.5 \cdot 10^{-6}$ | $2.4 \cdot 10^{-6}$ |
| 21 | 58.6 | — | 14.5 | 0.5 | 26.4 | 0.45 | $2.8 \cdot 10^{-4}$ | $0.5 \cdot 10^{-6}$ | $2.5 \cdot 10^{-6}$ |
| 22 | 46.8 | 11.8 | 14.5 | 0.5 | 26.4 | 0.45 | $2.3 \cdot 10^{-5}$ | $0.5 \cdot 10^{-6}$ | $2.5 \cdot 10^{-6}$ |
| 23 | 57.2 | — | 25.6 | 0.5 | 22.7 | 0.44 | $2.6 \cdot 10^{-4}$ | $0.5 \cdot 10^{-6}$ | $2.6 \cdot 10^{-6}$ |
| 24 | 41.0 | 10.2 | 25.6 | 0.5 | 22.7 | 0.44 | $2.7 \cdot 10^{-5}$ | $0.5 \cdot 10^{-6}$ | $2.6 \cdot 10^{-6}$ |
| 25 | 39.9 | 10.0 | 24.9 | 3.0 | 22.2 | 0.45 | $1.4 \cdot 10^{-5}$ | $0.5 \cdot 10^{-6}$ | $2.8 \cdot 10^{-6}$ |

As can be seen from Table 6, the leaching rates of the solidified products containing trass (with or without standard sand9 are always lower by a power of ten for Cs-137 than those for the product without trass (with or without standard sand). The leaching rates for Ru-106 and for Sb-125 remain unchanged and good.

It will be understood that the above description of the present invention is susceptible to various modifications, changes and adaptations, and the same are intended to be comprehended within the meaning and range of equivalents of the appended claims.

What is claimed is:

1. Process for solidifying radioactive waste wherein the waste is in solid or aqueous, flowable or liquid form, by mixing the waste with a binder to form a mixture and then leaving the mixture to harden, comprising: forming a mixture of the waste, the binder and an additive which is natural volcanic rock detritus, the detritus having a total content of CaO+MgO up to a maximum of 6.5 percent by weight and less than 50 percent by weight of residue insoluble in mineral acid, said detritus additive being mixed in an amount between 1 percent by weight and 60 percent by weight of the binder employed.

2. Process as defined in claim 1, wherein the volcanic rock detritus is a Rhenish trass.

3. Process as defined in claim 1, wherein the detritus additive is mixed with the binder before being mixed with the waste.

4. Process as defined in claim 1, wherein the waste is an aqueous waste and the detritus additive is mixed with the aqueous waste before being mixed with the binder.

5. Process as defined in claim 1, wherein the binder comprises an organic binder.

6. Process as defined in claim 1, wherein the binder comprises an inorganic binder.

7. Process as defined in claim 1, wherein the binder contains at least one further additive.

8. Process as defined in claim 1, wherein the waste is a boric acid or borate containing waste, and in addition to the additive in the form of natural volcanic rock detritus, the mixture is formulated to contain a further additive which is a suspension of $Ca(OH)_2$ in a quantity in the range from 3 percent by weight to 25 percent by weight $Ca(OH)_2$ based on the weight of the binder.

9. Process as defined in claim 8, wherein the waste is an aqueous solution or concentrate.

10. Process as defined in claim 8, wherein the waste is an ion exchanger.

11. Process according to claim 1, wherein the volcanic rock detritus contains 9.6 to 15.2 weight percent $Al_2O_3$, as determined after boiling the volcanic rock detritus in 20 percent HCl for 1 hour at reflux and after then further treating the resulting residue with a 2% NaOH solution.

* * * * *